US005176443A

United States Patent [19]

Lin

[11] Patent Number: 5,176,443

[45] Date of Patent: Jan. 5, 1993

[54] FLEXIBLE LIGHTING FIXTURE

[76] Inventor: Jack Lin, 4F, No. 112, Wen Lin N. Rd., Taipei, Taiwan

[21] Appl. No.: 830,906

[22] Filed: Feb. 4, 1992

[51] Int. Cl.[5] ..... F21S 1/12

[52] U.S. Cl. ..... 362/413; 362/419; 362/427

[58] Field of Search ..... 362/413, 419, 427

[56] References Cited

U.S. PATENT DOCUMENTS 4,858,092 8/1989 Lu ..... 362/413

5,008,793 4/1991 Copeland ..... 362/413

5,097,400 3/1992 Cvek ..... 362/419

*Primary Examiner*—Carroll B. Dority

*Attorney, Agent, or Firm*—Bacon & Thomas

[57] ABSTRACT

A flexible lighting fixture formed from vertical and horizontal guide rod assemblies pivotally connected to each other and to a lamp base and a lamp shade for providing enhanced elevation and projection of light, and permitting the fixture to be reduced to minimum size for packing and storage.

4 Claims, 5 Drawing Sheets

FLEXIBLE LIGHTING FIXTURE

BACKGROUND OF THE INVENTION

This invention relates to a dual-lever flexible lighting fixture applicable to being placed on desks in a household or office for providing illumination and thus facilitating working, reading and the like.

By means of a rotational lever, this fixture is connected with a vertical guide-rod and a horizontal flexible guide-rod. With a safety board added to the horizontal flexible guide-rod and an insulated clamp connected with the rotational lever, this fixture is economical to manufacture. Also, with the pivoting function of the flexible guide-rod, this fixture shall have a further reduced size after it is collapsed, thus significantly reducing the cost of packing and storage.

SUMMARY OF THE INVENTION

This invention is a "Dual-Lever Flexible Lighting Fixture" of which the major feature includes a pair of vertical fixing guide-rods and a pair of horizontal extending flexible guide-rods connected together by a pair of rotational levers between which an insulated clamp is connected, thus maintaining the individual electrical connection between the rotational levers and preventing possible shortcircuit resulting from any incidental contact between the various guide-rods and rotational levers and also provide excellent elevation angle, high & low position and projection range of the lighting fixture. Also, this invention shall have a smallest possible size for storage by means of the pivot formed by the recessed groove of the rotational lever and the embossed groove of the horizontal flexible guide-rod for high portability and easy relocation. Furthermore, the reduced size shall have a cost reduction in the packing material, which is indeed the practicality and innovation of this invention.

BRIEF DESCRIPTION OF THE DRAWINGS

The structure and construction of this invention are hereby described as follows in conjunction with the drawings and detailed description.

DETAILED DESCRIPTION OF THE PREFERRED EMBODIMENTS

Figure 1:
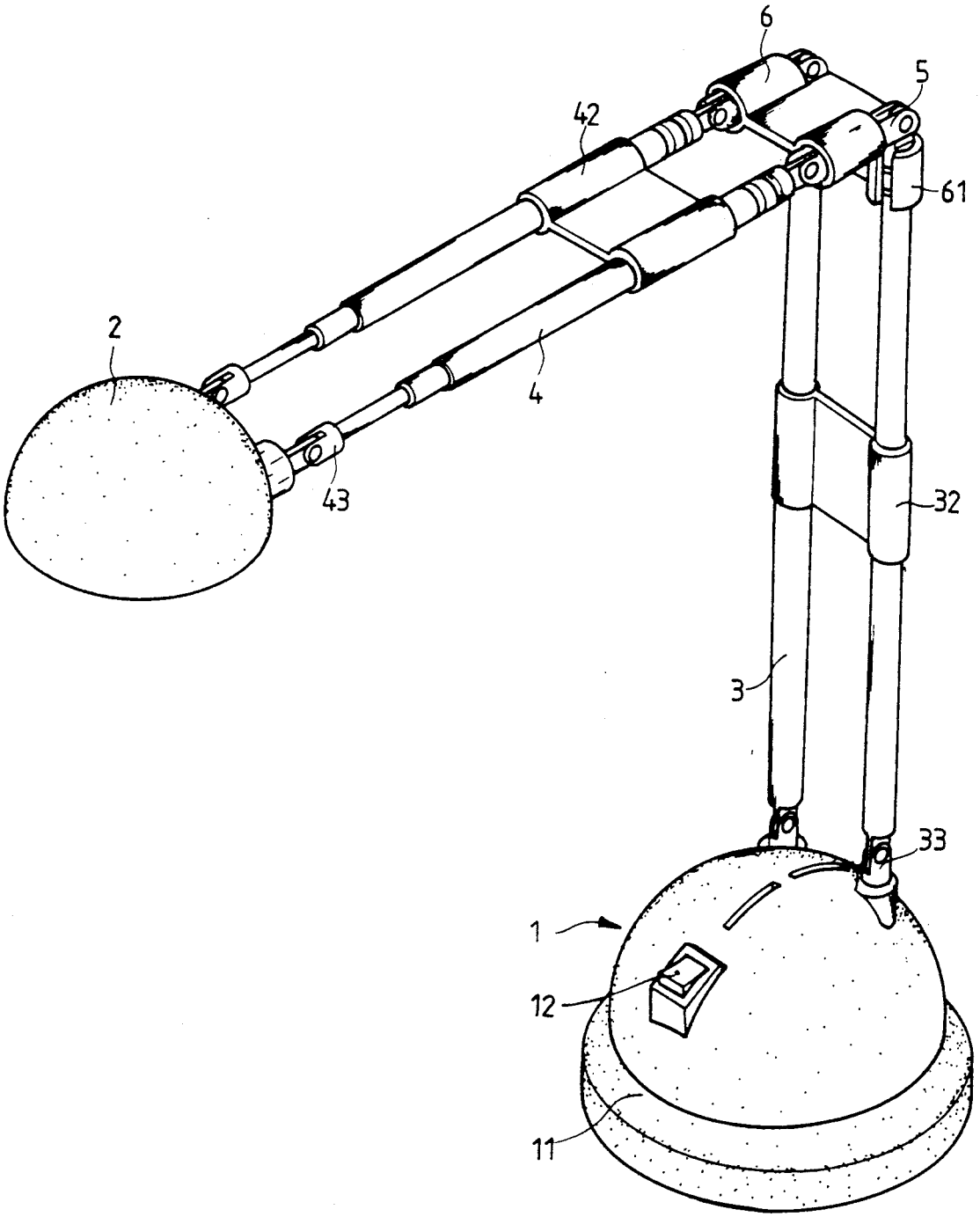
FIG. 1 is a perspective view of a first embodiment of this invention.

As shown in FIG. 1, this invention consists of Lamp Holder 1, Lamp Shade 2, Vertical Stationary Guide-Rod Assembly 3, Horizontal Extendible Guide-Rod Assembly 4, Rotational Lever Assembly 5 and Insulated Clamp 6. The body 11 of the lamp holder or base, power switch 12 and the transformer therein are conventional devices commonly known, and the bulb holder and bulb inside the lamp shade 2 are also of conventional structure. Described herein are only the structural features related to this invention.

Figure 2:
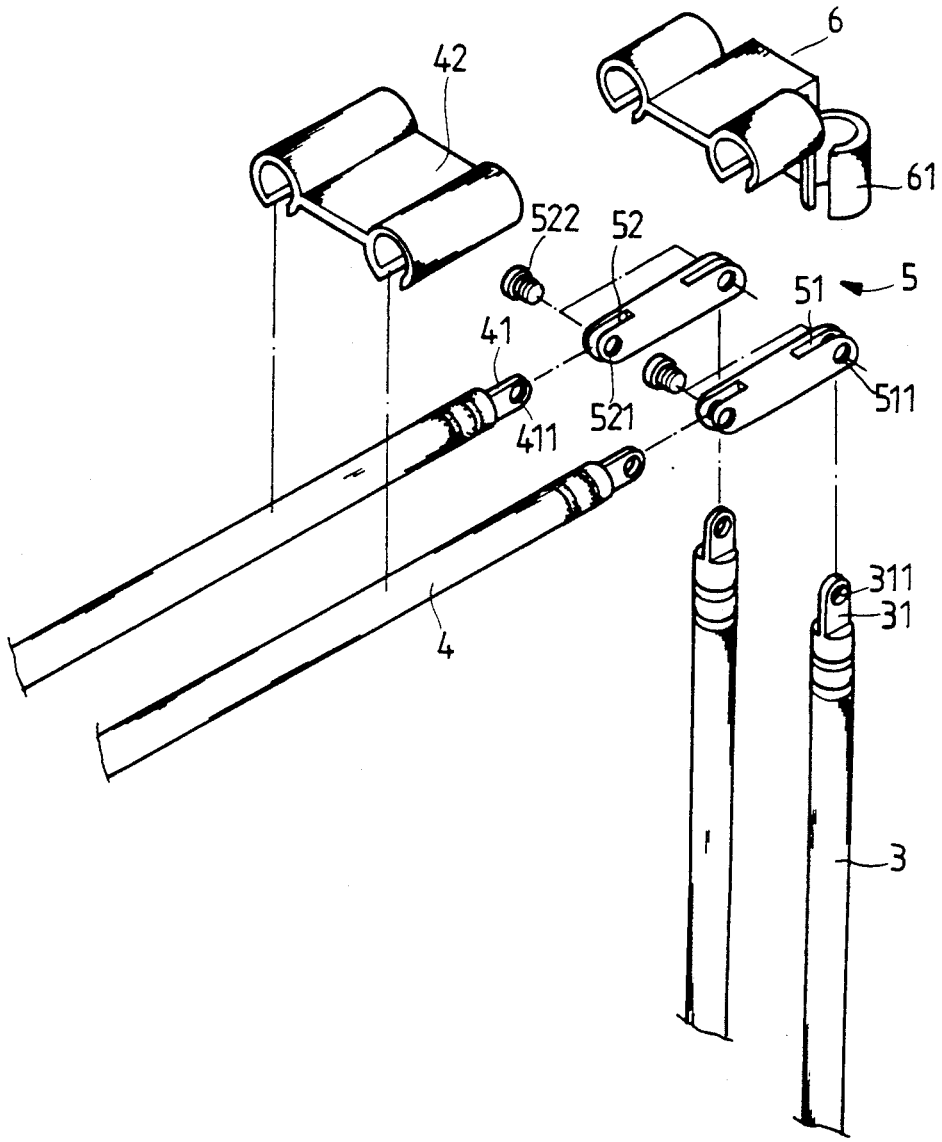
FIG. 2 is a partial exploded perspective view of the first embodiment.

As seen in FIGS. 1 and 2, vertical stationary guide-rod assembly (3) is made of a pair of metal guide-rods with a flange 31 on the upper end of each rod. A round hole 311 is formed in each flange 31 to receive the recessed groove 51 of each rotational lever 5 for connection with the round holes 511 on the opposite sides of the recessed grooves 51. The middle section of each guide-rod is connected with an insulated safety board 32 with a connecting pivot 33 to connect with Lamp Holder 1 at each bottom section.

Horizontal extendible guide-rod assembly (4) is a pair of flexible guide-rods made of metal, and each end of which is equipped with a connecting flange 41, of which there is provided a round hole 411 for connection with a recessed groove 52 of a rotational lever to form a bendable pivot. An insulated safety board 42 is connected between the guide-rods and the other ends thereof are each provided with a pivot 43 connected with Lamp shade 2.

Rotational lever 5 is made of two elongate metal bars, of which one end is provided with a recessed groove 51 and a screw hole 511 for receiving flange 31 of the vertical fixing guide-rod 3 for connection with a recessed groove 51 by means of screw 522, locking round hole 311 and screw hole 511. Another end is provided with a recessed groove 52 and a screw hole 521 for connection with the flange 41 of the horizontal flexible guide-rod and the positioning is made by screw 522, locking round hole 411 and screw hole 521.

Insulated clamp 6 assembly is connected with the vertical and horizontal body of the rotational lever with the electrical connection maintained by the removable sleeve clamps 61.

With the component parts mentioned above, this invention is capable of providing a lighting fixture with a wide projecting range and reduced for storage. This invention provides the pivot between the horizontal flexible guide-rod and the rotational lever, thus saving the packing cost and reducing the size of the product to facilitate handling.

Another feature of this invention is the pair of horizontal guide-rods 4, which are capable of adjusting the horizontal extension and the elevation angles thus obtaining enhanced projecting distance and range. Also, the over-tilting of the lever will not intrude upon the working space of the user.

Figure 3:
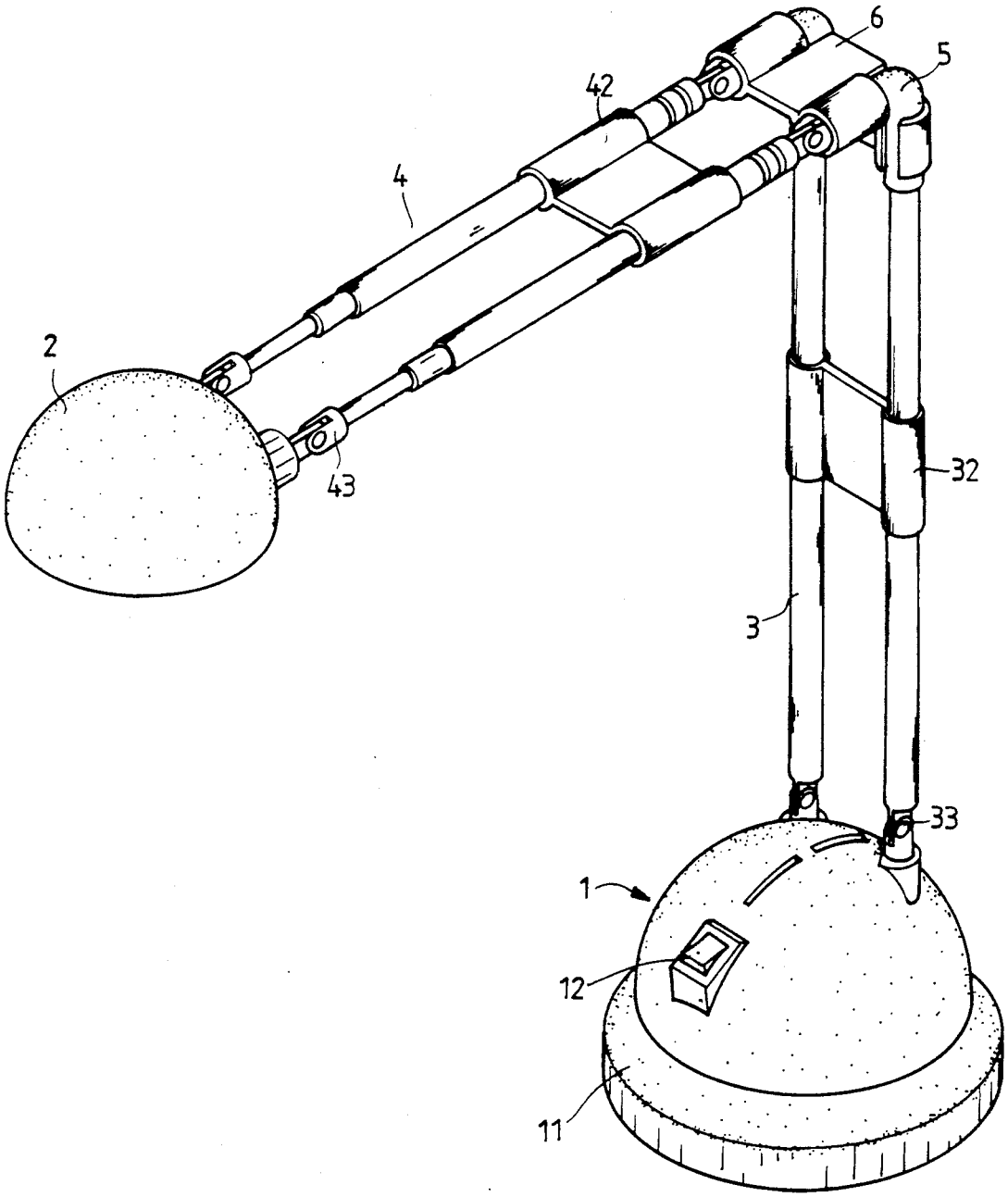
FIG. 3 is a perspective view of a second embodiment of this invention.
Figure 4:
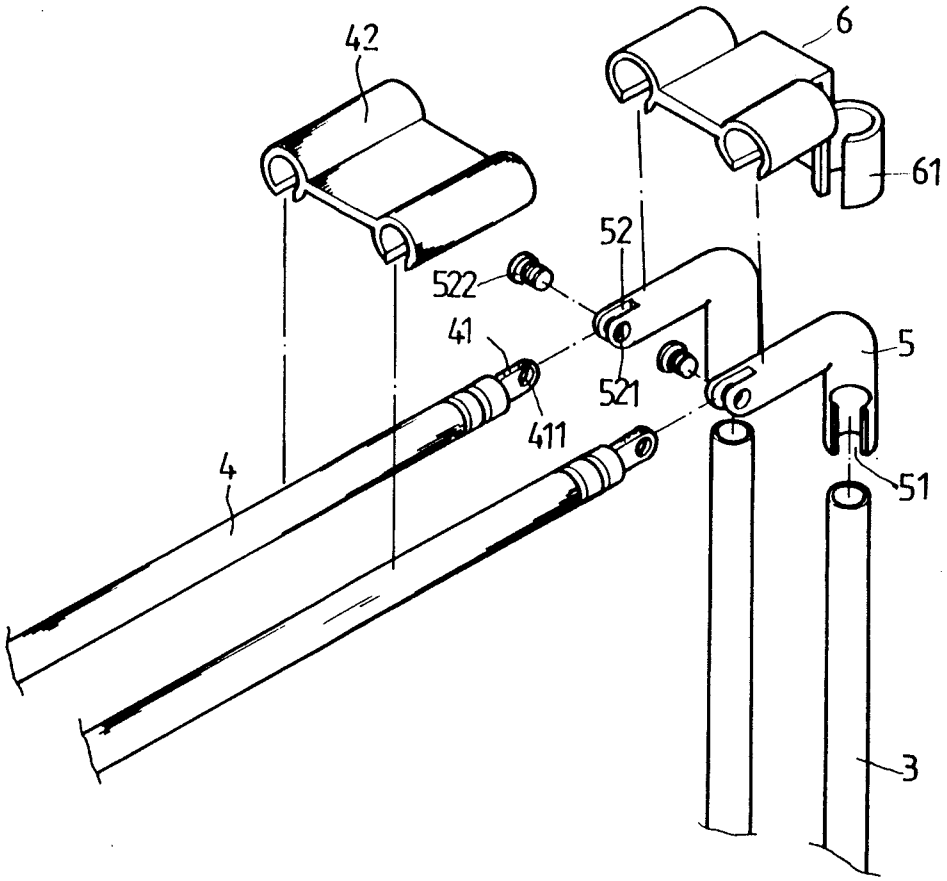
FIG. 4 is a partial exploded perspective view of the second embodiment.
Figure 5:
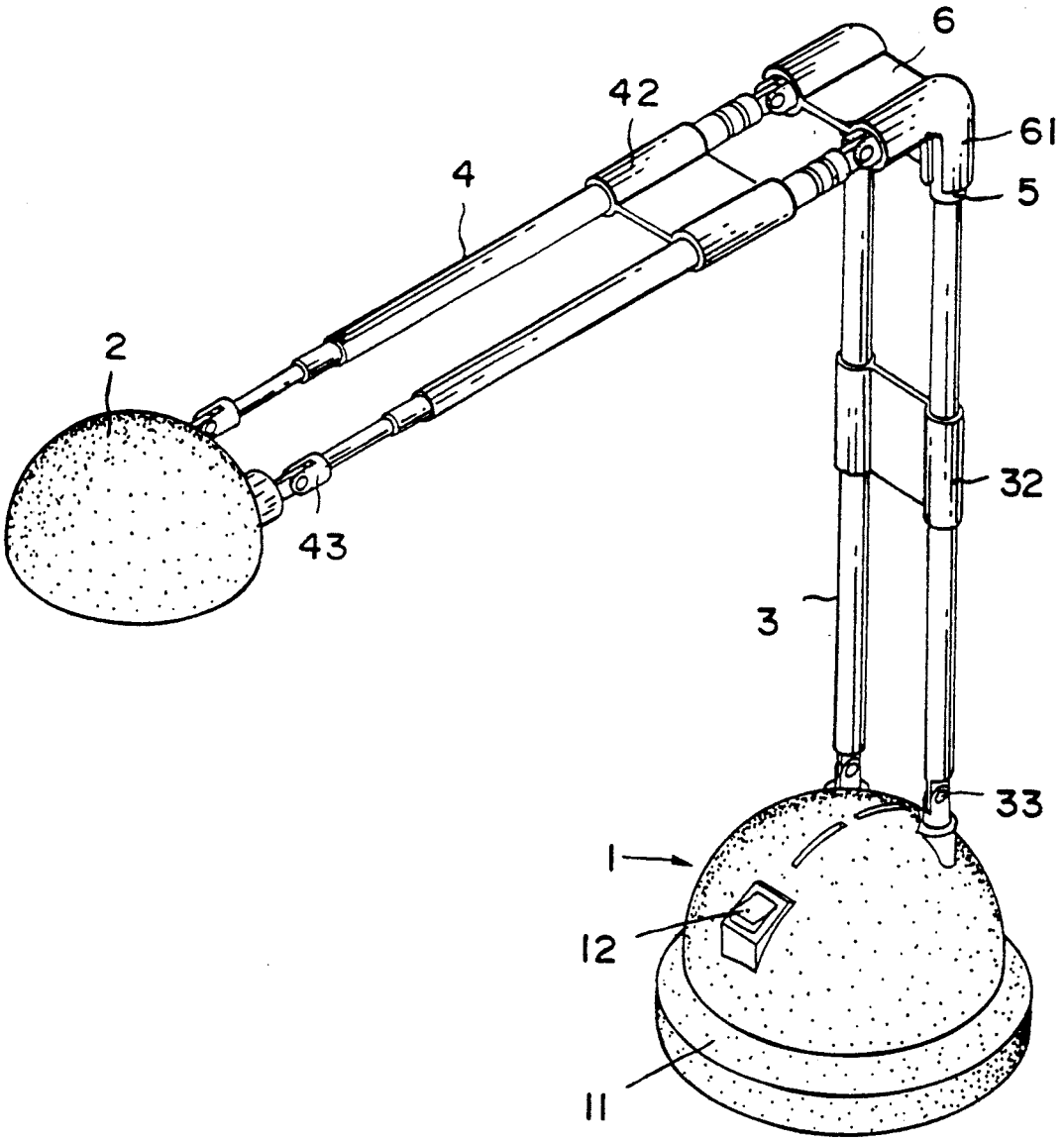
FIG. 5 is a perspective view of a third embodiment of this invention.

The rotational lever 5 of this invention can also be an L-Shape rod 5 as shown in FIGS. 3 and 4. Also the difference between the two rotational levers is that the rotational lever of FIG. 2 has a clamp including sleeve connecting round tubes 61 to cover the recessed groove 51, screw hole 511 of the rotational lever 5 for sleeve connection with the vertical fixing guide-rod 3. The clamp 6 of this invention can also be in the shape as shown in FIG. 5.

Summing up the above, this invention provides a wider light projecting range without affecting the working space of the user. This invention is also capable of reducing the size thereof for packing and storage.

I claim:

1. A flexible lighting fixture comprising:

a) a vertical guide rod assembly including first and second end portions;

b) a horizontal guide rod assembly including first and second end portions;

c) a rotational lever assembly pivotally connected to the first end portions of the guide rod assemblies;

d) a lamp base pivotally connected to the second end portions of the vertical guide rod assembly;

e) a lamp shade pivotally connected to the second end portions of the horizontal guide rod assembly;

f) an insulated clamp assembly disposed in engagement with the rotational lever assembly and the first end portions of the vertical guide rod assembly; and g) an insulated safety board mounted on each of the vertical and horizontal guide rod assemblies.

2. The lighting fixture of claim 1 wherein:

a) each of the vertical and horizontal guide rod assemblies includes a pair of spaced guide rods; and b) the first end portions of the guide rod assemblies include a pair of flanges, with each flange including a round hole formed therethrough; and c) the rotational lever assembly includes a pair of elongate bars, each elongate bar being provided with recessed grooves at its opposite ends, each recessed groove including an aperture formed therethrough, and each flange being pivotally secured within a recessed groove.

3. The lighting fixture of claim 2 wherein each elongate bar is of an L-shaped configuration.

4. The lighting fixture of claim 2 wherein the insulated clamp further includes a sleeve clamp for engaging the first end portions of the vertical guide rod assembly.

* * * * *